US008669449B1

(12) United States Patent
Feliciano

(10) Patent No.: US 8,669,449 B1
(45) Date of Patent: Mar. 11, 2014

(54) FLUTE HEAD-JOINT STOPPER

(76) Inventor: Roberto Feliciano, Bayamon, PR (US)

( * ) Notice: Subject to any disclaimer, the term of this patent is extended or adjusted under 35 U.S.C. 154(b) by 38 days.

(21) Appl. No.: 13/493,613

(22) Filed: Jun. 11, 2012

Related U.S. Application Data

(60) Provisional application No. 61/497,922, filed on Jun. 16, 2011.

(51) Int. Cl.
*G10D 7/02* (2006.01)

(52) U.S. Cl.
CPC ..... *G10D 7/026* (2013.01)
USPC ..... 84/384

(58) Field of Classification Search
CPC ..... G10D 7/026; G10D 7/02
USPC ..... 84/384
See application file for complete search history.

(56) References Cited

U.S. PATENT DOCUMENTS

| | | | | | |
|---|---|---|---|---|---|
| 444,830 | A * | 1/1891 | Guenther | 84/384 |
| 859,714 | A * | 7/1907 | Wurlitzer | 84/384 |
| 1,376,004 | A * | 4/1921 | Nils | 84/384 |
| 1,799,246 | A * | 4/1931 | Recker | 277/626 |
| 1,983,840 | A * | 12/1934 | Dohner | 285/341 |
| 2,364,447 | A * | 12/1944 | Hynes | 285/234 |
| 3,454,703 | A * | 7/1969 | Rose | 84/723 |
| 3,970,336 | A * | 7/1976 | O'Sickey et al. | 285/341 |
| 4,240,320 | A * | 12/1980 | Pellerite | 84/384 |
| 4,499,810 | A * | 2/1985 | Ferron | 84/384 |
| 4,672,878 | A * | 6/1987 | Senior | 84/384 |
| 4,770,080 | A * | 9/1988 | Jivoin | 84/330 |
| 6,660,919 | B2 * | 12/2003 | Lim | 84/384 |
| 7,361,822 | B1 * | 4/2008 | Hsieh | 84/410 |
| 2002/0178892 | A1 * | 12/2002 | Lim | 84/384 |
| 2007/0272071 | A1 * | 11/2007 | Parmenon | 84/384 |
| 2008/0106092 | A1 * | 5/2008 | Klein et al. | 285/5 |
| 2010/0018380 | A1 * | 1/2010 | Seidman | 84/384 |
| 2011/0233437 | A1 * | 9/2011 | Mattson et al. | 251/309 |
| 2012/0092881 | A1 * | 4/2012 | Ohai | 362/433 |

* cited by examiner

*Primary Examiner* — Robert W Horn
(74) *Attorney, Agent, or Firm* — Luis Figarella

(57) ABSTRACT

A flute stopper having at least one sealing means able to seal the musical cavity and translation means to adjust the positioning of said seal. Said flute stopper is designed to be capable of interfacing with the original factory screw, nut and crown via nuts and/or fittings, including either compression or NPT fittings. Both or either end of said plug may be tapered to facilitate said interfacing.

16 Claims, 3 Drawing Sheets

FLUTE HEAD-JOINT STOPPER

CROSS-REFERENCE TO RELATED APPLICATIONS

This application claims priority to U.S. provisional patent application Ser. No. 61/497,922 titled "Flute Head-Joint Stopper" filed on Jun. 16, 2011, the disclosure of which is herein incorporated by reference in its entirety.

PATENTS CITED

The following documents and references are incorporated by reference in their entirety, Seidman (U.S. Pub. No. 2010/0018380), Ferron (U.S. Pat. No. 4,499,810), Christensen (U.S. Pat. No. 1,376,004), Parmenon (U.S. Pub. No. 2007/0272071) and Pellerite (U.S. Pat. No. 4,240,320).

FIELD OF THE INVENTION

The present invention relates to an acoustically pleasing head joint stopper for a transverse flute.

Modern flutes, including concert flutes and piccolos, are often constructed of metal and include a body portion which is detachably connected to a head joint. The body portion includes the finger holes and keys and the head joint includes the embouchure hole and lip plate. Received in the free end of the head joint is a stopper. The stopper is that obstruction in the bore of the flute, just beyond the embouchure hole. It often takes the form of a cork, with or without a screw connection to the cap or crown, also usually made of cork and anchored to a crown fitting by a threaded engagement.

As the name implies, this "stopper" defines the cavity of the flute and it is usually set one bore diameter back from the middle of the embouchure. Although the body portion of the head joint is generally cylindrical, the head joint is typically a drawn or extruded member having a slightly tapering inside diameter. In the trade, the head joint inside diameter is often referred to as being conical. The end of the head joint which attaches to the body portion includes a slightly larger inside diameter than the opposite free end. The cork stopper can be inserted through either end of the head joint. In a Boehm flute, this is usually 17 mm, whereas in a 19th century conical flute it means 19 mm.

For preferred flute response, resonance and brilliance of tone quality, the geometry of the stopper, its position with respect to the embouchure hole and its ability to seal around the inside diameter of the head joint are all important factors. Cork, when used as a stopper, has the advantage of being lightweight, easily shaped, moderately compressible and low cost.

However, cork has its disadvantages. For instance, a certain amount of dampening in the head joint is necessary, but the very nature of cork sometimes provides too great a degree of dampening. Such dampening adversely affects the sound quality of the instrument. Cork also deteriorates with exposure to moisture and actually decreases in size over time. Consequently, a flute cork stopper begins to develop air leaks which gradually become worse. In many cases, the flautist may be unaware of such leaks gradual leaks, or incapable of ascertaining the cause of the decrease in flute performance.

Further, if the quality of cork which was obtained for the fabrication of such head joint stoppers is porous, then the deterioration will be much more rapid. This results in a deterioration of the sonic quality of the flute, which is undesirable.

What is needed is an airtight stopper structure that remains airtight over time in spite of its exposure to environmental conditions and use.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a flute stopper comprising a mechanical plug having O-ring securing means at a first end and flute crown screw securing means at a second end, said plug having an opening through said plug's center and an O-ring. In another aspect said O-ring securing means are comprised of a U-channel groove. In yet another aspect said flute crown screw securing means are comprised of a nut. In another aspect said flute crown screw securing means are comprised of a flat nut. In yet another aspect said flute crown screw securing means are comprised of an NPT fitting. In another aspect said plug's second end inside is tapered and said flute crown screw securing means are comprised of a compression fitting. In yet another aspect said plug's first end inside has a tapered or conical shape.

In one aspect said O-ring securing means are comprised of an open rim groove. In yet another aspect said flute crown screw securing means are comprised of a nut. In another aspect said flute crown screw securing means are comprised of a flat nut. In yet another aspect said flute crown screw securing means are comprised of an NPT fitting. In another aspect said plug's second end inside is tapered and said flute crown screw securing means are comprised of a compression fitting. In yet another aspect said plug's first end inside has a tapered or conical shape.

Other features and advantages of the present invention will become apparent upon examining the following detailed description of an embodiment thereof, taken in conjunction with the attached drawings.

The above-described and other features will be appreciated and understood by those skilled in the art from the following detailed description, drawings, and appended claims.

DETAILED DESCRIPTION OF THE PREFERRED EMBODIMENT

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Figure 1:
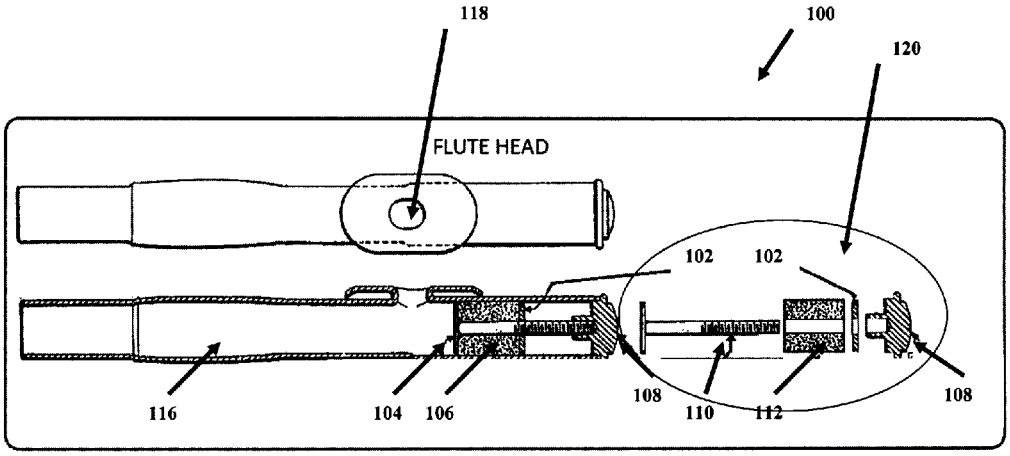
FIG. 1 shows an illustration of a traditional cork stopper, according to an illustrative embodiment.

Referring to FIG. 1, we see a traditional flute head 100 and its parts. The opening, called an embouchure hole 118, is at the head of the unit, usually next to the stopper assembly 120, comprised of a factory flat nut 102, a screw stopper 104, a standard cork portion 106, a flute crown nut 108 and factory screw 110. The cork 106 has an outer diameter significantly similar to the inner diameter of the flute head, so that when assembled and inserted into the flute, it effectively sets the length of the cavity 116, and hence the sound of the flute.

Figure 2:
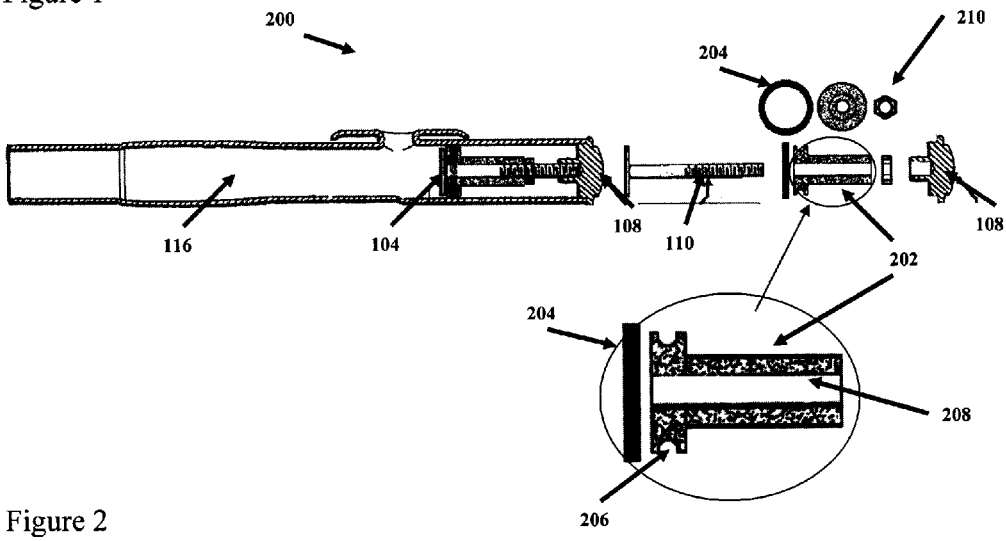
FIGS. 2-6 show illustrations of exemplary embodiments of the invention.

Referring to FIG. 2 we see one embodiment of a new stopper assembly 200 and its interface to the flute head. The cork's cavity 116 sealing function is performed by an O-ring 204 mounted in a mechanical plug 202. The outer diameter of said O-ring is designed to fit snuggly within the flute head's inner diameter, so that the cavity 116 is sealed. The mechanical plug 202 has an opening or hole traveling through its center 208 from end to end, so that the original factory screw 110 may slide through it. The screw stopper 104 at the cavity (or lower) end acts as a resting place for the plug 202, with the upper end (the end closer to the crown nut 108) of the plug 202 is held by a nut or compression fitting. In this fashion, when the assembly is inserted into the flute and connected to the flute crown nut 108, the complete assembly is displaced into/out of the cavity 116 (and therefore tuning it) by rotating the crown nut 108.

The compression ring choice of material has been found to induce different sound characteristics to the flute sound. When brass or another metal is used, the sound is different from that of a nylon or other plastic.

In one embodiment, the plug distal end is secured by the original factory flat nut 102. In an alternate embodiment, a smaller nut 210 is used. In both cases, there is the risk that over time, either nut (102, 210) may become lose, introducing some bias or 'play' into the adjustment. In one embodiment, a pressure washer may added between the plug 202 and the nut.

Figure 4:
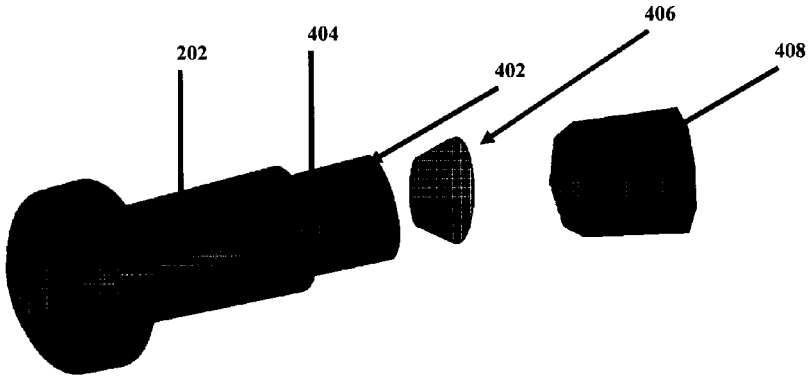
Figure 5:
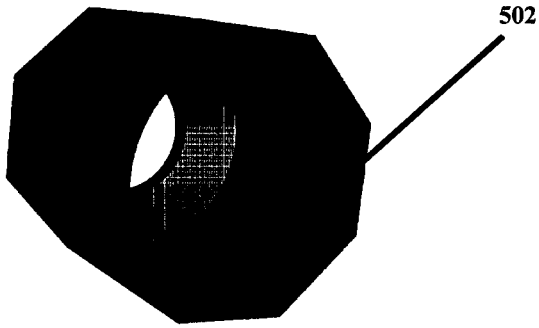

In another embodiment, a compression fitting is used to secure the plug 202 to the factory screw 110. By placing a thread 404 around and shaping the inside of the top 402 of the plug (FIGS. 4-5), it is possible to insert a compression ring or ferrule 406, which in turn is pressed by a top nut 408 having a thread 502 compatible with that 404 of the plug 202. Tightening the top nut 408 proceeds to compress the ring against the screw 110, in effect pressing down the bottom of the plug 202 into the screw stopper 104 end of the screw 110, and securing it to the screw 110.

In an alternate embodiment, the bottom 402 is shaped as an NPT fitting (either round, conical, or double conical), accomplishing the same compression to the top nut 408. In all cases, when the screw 110 goes into the crown nut 108, rotation of the nut 108 will result in displacement of the assembly within the cavity 116 and tuning.

In one embodiment, the plug 202 has a dual rimmed O-ring groove (or U-channel) portion 206 designed to hold the O-ring 204. In this fashion, the pressing surface of the O-ring 204 seals the perimeter of the plug/cavity interface, performing the sealing of the cavity 116 function the cork 106 performed previously, and effectively setting the length of the cavity 116.

Figure 3:
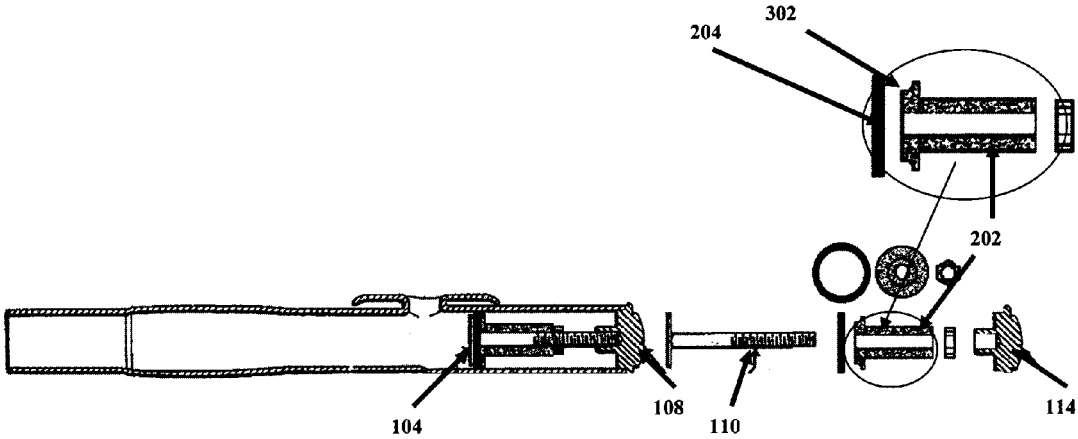
Figure 6:
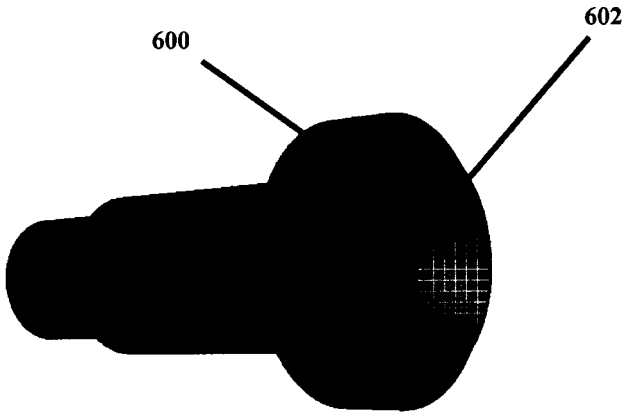

In an alternate embodiment (FIGS. 3 and 6) the bottom of the plug 202 is an open rim groove, having a single rim 600, against one side of which the O-ring rests, leaving the other side open. This makes is easier to insert the O-ring 204. The O-ring 204 is held in place by the screw stopper 104 end of the screw 110, which is attached to the top of the plug 202. As before, this may be accomplished either by nuts (102, 210), NPT or compression fitting. In another embodiment, the groove is a triangular groove.

A singular advantage is that the diameter of the O-ring 204 may be adjusted by the tightening of the top nut 408, which presses the bottom or first end of the plug 202 into the screw stopper 104, thus squeezing the O-ring and increasing its effective diameter. The inside of the bottom 602 is tapered in order to accommodate both types of screw stoppers 104 in the market. Some are flat as shown, others are tapered or semi-conical, and would nestle inside the shape of the bottom 602.

The plug 202 may be manufactured of a combination of materials, including ferrous and non-ferrous metals (brass, copper, etc.), bone, wood and polymers, plastic or thermoplastics. These include such well known materials as nylon, ABS ("acrylonitrile butadiene styrene") or other such moldable plastics.

The O-ring may also be manufactured from such polymers, silicone, natural or synthetic rubber, leather, etc. More information on proper O-ring materials and design can be found on the Parker O-Ring Handbook (ORD 5700) the contents of which are incorporated herein by reference.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. A flute stopper comprising;

a mechanical plug having a distal end with a diameter that is slightly smaller than the head joint body interior diameter, said distal end having a U-channel groove for securing a single O-ring, so that only said single O-ring perimeter continuously contacts the flute interior surface, and a narrow diameter near end having flute crown screw securing means, said plug having an opening through said plug's center suitable for passage through said opening of a head joint screw; and an O-ring.

2. The flute stopper of claim 1 wherein;

said flute crown screw securing means are comprised of a nut smaller than the diameter of the head joint that is used to lock the movement of said plug body to that of the head joint screw.

3. The flute stopper of claim 1 wherein;

said flute crown screw securing means are comprised of a flat nut smaller than the diameter of the head joint that is used to lock the movement of said plug body to that of the head joint screw.

4. The flute stopper of claim 1 wherein;

said flute crown screw securing means are comprised of an NPT fitting nut smaller than the diameter of the head joint that is used to lock the movement of said plug body to that of the head joint screw.

5. The flute stopper of claim 1 wherein;

said plug's near end inside is tapered, and said flute crown screw securing means are comprised of a compression fitting having a compression ring smaller than the diameter of the head joint that is used to lock the movement of said plug body to that of the head joint screw.

6. The flute stopper of claim 5 wherein;

said compression ring is made of nylon.

7. The flute stopper of claim 5 wherein;

said compression ring is made of brass.

8. The flute stopper of claim 5 wherein;

said plug's distal end inside has a tapered or conical shape.

9. A flute stopper comprising;

a mechanical plug having a distal end with a diameter that is slightly smaller than the head joint body interior diameter, said distal end having an open rim groove for securing a single O-ring, so that only said single O-ring perimeter continuously contacts the flute interior surface, and a narrow diameter near end having flute crown screw securing means, said plug having an opening through said plug's center suitable for passage through said opening of a head joint screw; and an O-ring.

10. The flute stopper of claim 9 wherein;

said flute crown screw securing means are comprised of a nut smaller than the diameter of the head joint that is used to lock the movement of said plug body to that of the head joint screw.

11. The flute stopper of claim 9 wherein;

said flute crown screw securing means are comprised of a flat nut smaller than the diameter of the head joint that is used to lock the movement of said plug body to that of the head joint screw.

12. The flute stopper of claim 9 wherein;

said flute crown screw securing means are comprised of an NPT fitting smaller than the diameter of the head joint that is used to lock the movement of said plug body to that of the head joint screw.

13. The flute stopper of claim 9 wherein;

said plug's near end inside is tapered, and said flute crown screw securing means are comprised of a compression fitting having a compression ring smaller than the diameter of the head joint that is used to lock the movement of said plug body to that of the head joint screw.

14. The flute stopper of claim 13 wherein;

said compression ring is made of nylon.

15. The flute stopper of claim 13 wherein;

said compression ring is made of brass.

16. The flute stopper of claim 13 wherein;

said plug's distal end inside has a tapered or conical shape.

* * * * *